US009308428B1

(12) United States Patent
Shah

(10) Patent No.: US 9,308,428 B1
(45) Date of Patent: Apr. 12, 2016

(54) GOLF TRAINING AID

(71) Applicant: Sarmad A. Shah, Louisville, KY (US)

(72) Inventor: Sarmad A. Shah, Louisville, KY (US)

( * ) Notice: Subject to any disclaimer, the term of this patent is extended or adjusted under 35 U.S.C. 154(b) by 23 days.

(21) Appl. No.: 14/449,422

(22) Filed: Aug. 1, 2014

(51) Int. Cl.
*A63B 69/36* (2006.01)

(52) U.S. Cl.
CPC ..... *A63B 69/3632* (2013.01); *A63B 2220/50* (2013.01); *A63B 2243/0029* (2013.01)

(58) Field of Classification Search
CPC ..... A63B 69/36; A63B 69/3641; A63B 69/3623; A63B 69/3632; A63B 2220/50; A63B 15/00; A63B 15/005
USPC ..... 473/231, 232, 233, 234, 235, 256, 257, 473/219, 242, 224; 482/109, 121–127, 44; 434/252; 446/417–422, 246, 266; 84/402
See application file for complete search history.

(56) References Cited

U.S. PATENT DOCUMENTS

| | | | | | |
|---|---|---|---|---|---|
| 1,141,434 | A * | 6/1915 | Tosta | A63H 13/20 | 446/246 |
| 2,388,463 | A | 11/1945 | Benecke | | |
| 2,396,408 | A | 3/1946 | Benecke | | |
| 2,482,015 | A * | 9/1949 | McConnell | A63B 69/3638 | 473/226 |
| 3,428,325 | A | 2/1969 | Atkinson | | |
| 3,498,616 | A | 3/1970 | Hurst | | |
| 3,529,826 | A | 9/1970 | Hulyk | | |
| 3,743,297 | A | 7/1973 | Dennis | | |
| 4,598,911 | A * | 7/1986 | Lepera | A63B 69/3632 | 434/252 |
| 4,658,694 | A * | 4/1987 | Marks et al. | G10K 3/00 | 446/422 |
| 4,664,388 | A * | 5/1987 | Huber | A63B 67/20 | 273/DIG. 20 |
| 4,878,673 | A * | 11/1989 | Pollard | A63B 15/005 | 473/256 |
| 5,026,064 | A | 6/1991 | Novosel | | |
| 5,121,925 | A | 6/1992 | Blundo | | |
| 5,195,748 | A | 3/1993 | Koch et al. | | |
| 5,405,139 | A * | 4/1995 | Gagarin | A63B 15/00 | 473/232 |
| 5,489,100 | A | 2/1996 | Potter | | |
| 5,505,454 | A * | 4/1996 | Gagarin | A63B 15/00 | 473/232 |
| 5,556,345 | A | 9/1996 | Whitesell | | |
| 5,599,021 | A * | 2/1997 | Lary et al. | A63B 15/00 | 473/219 |
| 5,776,006 | A | 7/1998 | Gruber | | |
| 5,807,183 | A | 9/1998 | Benson | | |
| 6,461,163 | B1 | 10/2002 | Gallagher et al. | | |
| 6,599,201 | B1 | 7/2003 | Grant | | |
| 7,115,043 | B2 | 10/2006 | Leadbetter et al. | | |
| 7,311,612 | B2 | 12/2007 | DeLucia | | |
| 7,785,211 | B2 | 8/2010 | Hackenberg | | |
| 8,540,584 | B1 * | 9/2013 | Sorenson | A63B 69/36 | 473/219 |
| 2003/0224867 | A1 | 12/2003 | Ota | | |

FOREIGN PATENT DOCUMENTS

| | | |
|---|---|---|
| CN | 201384840 | 1/2010 |
| JP | 2001009077 | 1/2001 |
| JP | 2012090941 | 5/2012 |
| WO | 8403447 | 9/1984 |

* cited by examiner

*Primary Examiner* — Sebastiano Passaniti
(74) *Attorney, Agent, or Firm* — Middleton Reutlinger

(57) ABSTRACT

Apparatus and methods relating to a golf training aid having a pair of substantially coplanar shafts are disclosed herein. Swinging the golf training aid through a predetermined or proper swing plane may result in alignment of the shafts and/or members attached thereto. Separation or contact of the shafts or members attached thereto may be used to indicate proper acceleration or swing force.

20 Claims, 7 Drawing Sheets

GOLF TRAINING AID

TECHNICAL FIELD

Generally, a golf training aid is taught. More particularly, a golf training aid is taught having a shaft that is flexible, or bendable relative to another shaft, with each shaft having an end member for contacting the other end member.

BACKGROUND

An improper golf swing will usually result in less than desirable performance and/or scoring when playing golf. A proper golf swing, on the other hand, is almost sure to improve one's golf score and most likely to improve one's enjoyment of the game as well. However, a proper golf swing is difficult to achieve consistently.

One aspect of an individual's golf swing that should generally be practiced to improve the golf swing is the swing path. Swinging a golf club along a proper swing path facilitates a straight and/or desirable flight path of the golf ball. An improper swing path may result in hitting the ball left or right (e.g., a pull or push) of the desired flight path and/or may result in a flight path having undesirable curvature (e.g., a hook or a slice).

Another aspect of an individual's swing that may likely affect his or her golf game is the acceleration of the golf club at various points in the swing. For example, professional golfers tends to begin accelerating the golf club at the start of the downswing and to continue acceleration of the golf club through impact with the golf ball.

Devices have been developed and/or implemented to help an individual improve his or her golf swing. Some are intended to focus on achieving a desired swing path, and others are intended to focus on achieving desired swing speeds. However, such devices are of limited effectiveness. Moreover, such devices do not effectively assist with achieving a proper swing path and proper golf club acceleration.

Thus, there is a need in the art for overcoming the issues of existing systems.

The information included in this Background section of the specification, including any references cited herein and any description or discussion thereof, is included for technical reference purposes only and is not to be regarded subject matter by which the scope of any embodiment or claim is to be bound.

SUMMARY

The present disclosure is directed toward methods and apparatus for a golf training aid. The training aid includes two shafts that extend from a handle (e.g., a golf grip) in a cantilever fashion, with each shaft terminating with or near an end member that may contact the other end member. The shafts may bend, flex, and/or deflect relative to each other so that the end members may separate when subjected to a force (e.g., a downswing), and may reattach or contact each other when the force is removed or reduced and the end members are in alignment. The end members and/or shafts can be sized, shaped, and/or located such that the end members align (and reattach or contact one another) when being swung through (or nearly through) a desired swing path or swing plane, while not reattaching or contacting one another when sufficiently unaligned in the desired swing path or swing plane. Thus, the training aid may be used to indicate when it has been swung properly. Moreover, structural members and/or weights may be added, for example, to either or both shafts to vary the difficulty of achieving aligned relationship and/or contact of the end members through a golf swing.

Generally, in one aspect, a golf training aid is provided having a handle, a first shaft and a first end member, as well as a second shaft and a second end member. The first shaft and the second shaft extend away from the handle, and the shafts extend in co-planar relationship in a first plane. The first end member is connected to a terminal end of the first shaft, which is opposite the handle end of the first shaft connected to the handle. The second end member is connected to a terminal end of the second shaft, which is opposite the handle end of the second shaft connected to the handle. The first end member has a first attachment area that is proximate the second end member, and the second end member has a second attachment area that is proximate the first end member. These attachment areas are removably attachable to one another by an attachment mechanism when they are aligned in the first plane. The end members separate when subjected to a swing force.

Optionally, the second shaft may be more flexible than the first shaft. Alternatively, the shafts may have substantially the same stiffness, in which case one or more weights may be added to either or both shafts to help cause separation of the shafts when subject to the swing force. A spacing adapter may further be included, with the spacing adapter positioned on the first shaft and the second shaft. If included, the spacing adapter may be a sufficiently resilient structural member that ties the shafts together at the location the spacing adapter is attached, thereby reducing the cantilevered length of the shafts (and increasing the reinforced proximal portion of the shafts), which in turn will vary and/or reduce the difficulty level of causing the end members to align, attach, and/or contact one another. If included, the spacing adapter may be positioned on the shafts at a variety of locations so that the length of reinforced proximal portions of the shafts and/or the length of the cantilevered portions of the shafts may be varied. Optionally, the end members may provide an indication when swung through the first plane, as desired. Such an indication, if provided, may be an attachment condition of the end members and/or attachment areas of the end members. The end members may be formed substantially as balls and/or may include outer covers.

Generally, in another aspect, a golf training aid is provided having a handle, a first shaft and first end member, as well as a second shaft and second end member. The shafts extend outwardly away from the handle in the longitudinal direction in which the handle also extends. The shafts are coplanar and are spaced apart from one another. Each shaft has a handle end connected to the handle, although either of these connections to the handle may be indirect, such as through an adapter interposed between the shaft(s) and handle. Each shaft also has a terminal end opposite the handle end. The first end member and second end member are connected to the first shaft terminal end and the second shaft terminal end, respectively. In a resting condition, the first end member and second end member are in contact, but this contact may be removed by separation of the end members when subjected to a swing force. Even while in the resting condition, the contact of the end members retains the shafts in spaced apart relationship. The second shaft is more flexible than the first shaft to allow separation of the end members when subjected to the swing force.

Optionally, a spacing adapter may be positioned on the first shaft and on the second shaft, and may be sufficiently resilient to tie the shafts together at the location it is positioned, substantially preventing the shafts from flexing along a proximal portion between the spacing adapter and the handle ends of the shafts (thereby reducing the length of the cantilever portion of the shafts and reducing the difficulty of aligning the end members during a swing). The spacing adapter may be positioned at a variety of locations on the shafts to provide variability of the lengths of the reinforced proximal portions or the cantilever portions, and/or to allow easy variability of the difficulty of aligning the end members during a swing. Optionally, the end members and/or the end member attachment areas may provide an indication when swung through the first plane (which may be the desired swing plane). For example, the indication may be attachment of the end members and/or end member attachment areas, and/or the indication may be visual and/or audible. Outer cover(s) may be provided to cover at least a portion of the end member(s).

Generally, in yet another aspect, a golf training aid is provided having a handle, a first shaft, and a second shaft, with each shaft having an end member at a terminal end opposite the shaft end connected to the handle. Each shaft extends away from the handle and the shafts extend through a first plane. The first end member and the second end member are removably attached by an attachment force when aligned in the first plane. The second shaft is able to deflect more than the first shaft in the first plane due to a downswing having a swing force. This swing force causes separation of the end members. Deviation of the downswing from the first swing plane causes the end members to be unaligned and therefore the attachment areas of the end members do not attach or contact one another. Optionally, a spacing adapter may be positioned on the shafts to form a reinforced proximal portion of the shafts (between the spacing adapter and the handle ends) as well as a cantilever portion of the shafts (between the spacing adapter and the terminal ends). The spacing adapter may be substantially resilient to prevent shaft flexure or deflection along the reinforced proximal portion, while still allowing flexure or deflection along the cantilevered portions. The spacing adapter thus may be used to vary the difficulty of causing the end members and/or end member attachment areas to align, attach, and/or contact one another.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of any present embodiment is provided in the following written description of various embodiments, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, and emphasis instead is generally placed upon illustrating the principles of the embodiments depicted.

DETAILED DESCRIPTION

Figure 1:
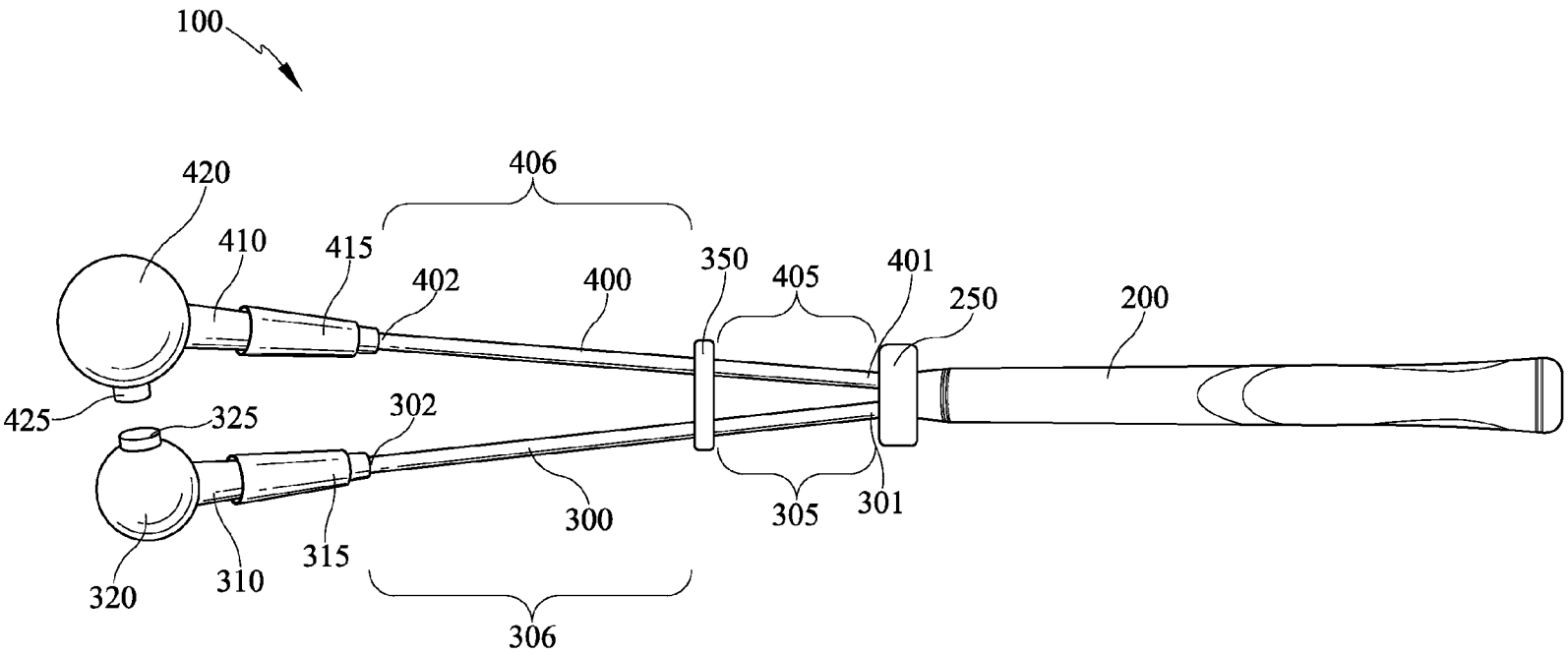
FIG. 1 is a perspective view of an embodiment of a golf training aid.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Figure 2:
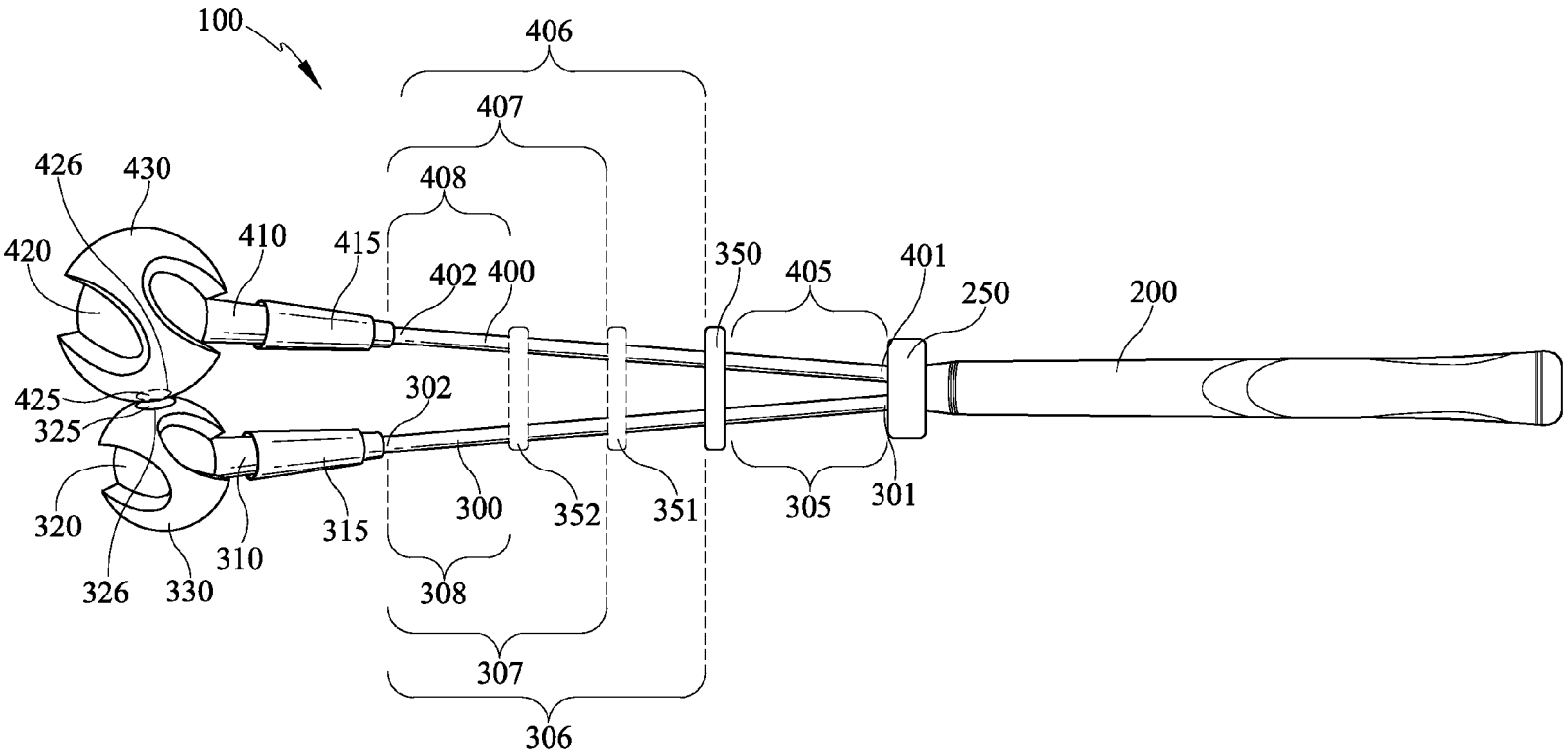
FIG. 2 is a perspective view of another embodiment of a golf training aid.
Figure 3:
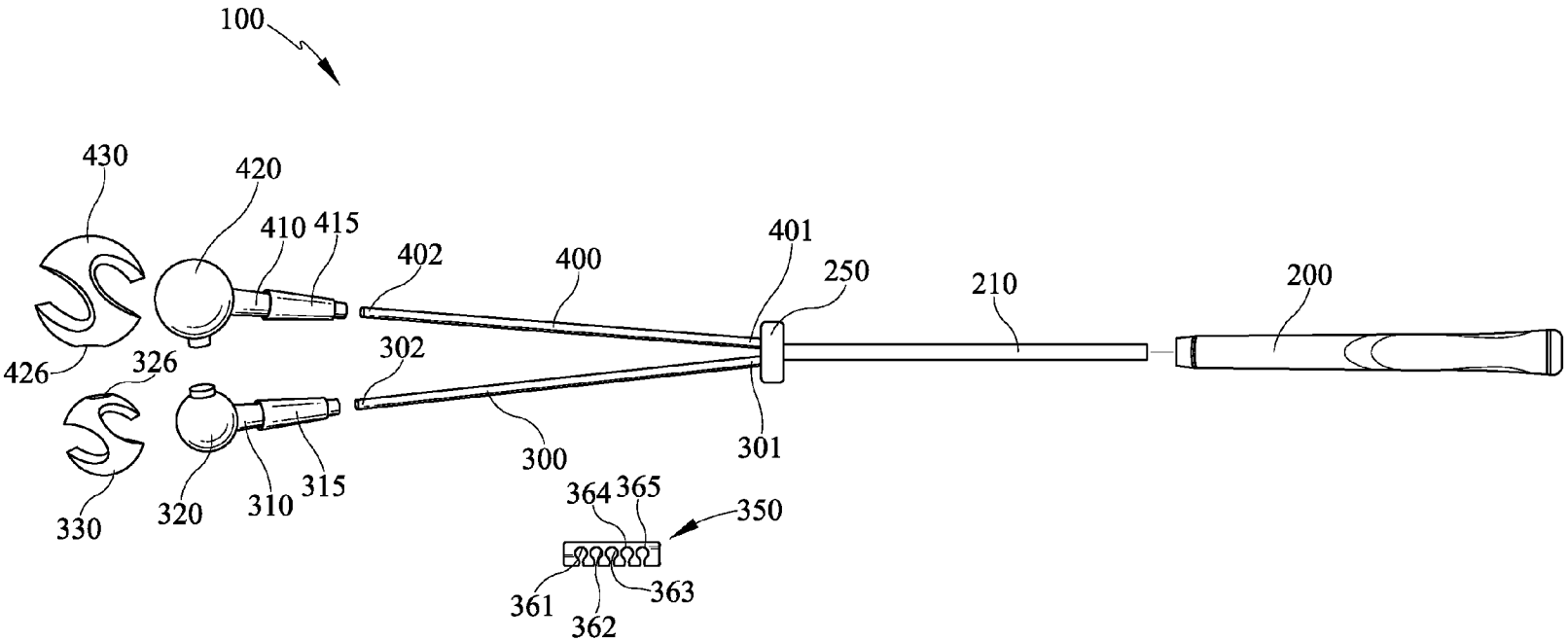
FIG. 3 is an exploded perspective view of the golf training aid of FIG. 2.

Referring initially to FIGS. 1-3, an embodiment of a golf training aid 100 is illustrated having a longitudinally extending grip or handle 200, a first extension member or first shaft 300, a second extension member or second shaft 400, a first end member 320, and a second end member 420. Golf training aid 100 may be swung by a user, for example, by gripping handle 200 as if gripping a golf club, and swung as though swinging a golf club (see e.g., FIG. 4). First shaft 300 and second shaft 400 may be substantially coplanar (i.e. having substantially coplanar longitudinal axes) in, for example, a first plane. First shaft 300 and second shaft 400 may be in a substantially spaced apart relationship, for example, as shown, which may, for example, facilitate retaining first end member 320 and second end member 420 in a configuration in which they may contact one another but also may be separated due to, for example, bending or flexing of first shaft 300, second shaft 400, or both. In this way, golf training aid 100 may be swung through a swing plane (which may be at least partially defined by the swing path of handle 200) such that first shaft 300 and second shaft 400 remain substantially in coplanar relationship with one shaft following the other. For example, first shaft 300 may lead second shaft 400 and/or second shaft 400 may follow first shaft 300 through the swing plane. When the first plane, in which first shaft 300 and second shaft 400 lie, and the swing plane are substantially coplanar, first shaft 300 and second shaft 400 may remain substantially aligned such that first end member 320 and second end member 420 remain substantially aligned (see e.g., FIG. 6A).

Golf training aid 100 may include a first adapter 250 which may, for example, be used to connect and/or attach handle 200 to first shaft 300 and/or second shaft 400. In some embodiments, handle 200, first shaft 300, and second shaft 400 may be substantially coplanar, although it is understood that they are not required to be coplanar or substantially coplanar. First shaft 300 may have a first handle end 301 proximate handle 200 and/or first adapter 250, and first shaft 300 may have a first terminal end 302 oppositely disposed first handle end 301. First shaft 300 may have a length that may extend outwardly from first handle end 301 to or toward first terminal end 302. Second shaft 400 may have a second handle end 401 proximate handle 200 and/or first adapter 250, and second shaft 400 may have a second terminal end 402 oppositely disposed second handle end 401. Second shaft 400 may have a length that may extend outwardly from second handle end 401 to or toward second terminal end 402. In some embodiments, handle 200 may include a golf grip and/or an internal shaft 210, which may provide structural support for grip or handle 200 and/or a convenient method of attachment to first adapter 250, first shaft 300, and/or second shaft 400, for example. In some exemplary embodiments, provided as non-limiting examples only, either or both of first shaft 300 and 400 may be approximately 20" in length (e.g., for junior users), approximately 23" (e.g., for lady users), and/or approximately 30" (e.g., for adult men users).

First end member 320 may be attached, coupled, and/or connected to first shaft 300, for example, by a first connection member 310. Second end member 420 may be attached, coupled, and/or connected to second shaft 400, for example, by a second connection member 410. In this way, first end member 320 and second end member 420 may be held at a predetermined location, which may be defined at least partially by first shaft 300 and/or first connection member 310 (for first end member 320) and/or at least partially by second shaft 400 and/or second connection member 410 (for second end member 420). In some embodiments, in a resting position or resting condition (e.g., when golf training aid is not being swung or subject to a swing force) first end member 320 and second end member 420 may be located proximate one another and/or in contact with one another. An attachment condition and/or a contact condition may exist wherein first end member 320 (or a component or portion thereof) is attached to and/or in contact with second end member 420 (or a component or a portion thereof). Such an attachment condition or a contact condition may exist, for example, during the aforementioned resting condition and/or at any point during a golf swing, for example, as described below.

Optionally, in some embodiments, either or both of a first sleeve 315 and a second sleeve 415 may be included for any of a variety of reasons, including, but not limited to, as an intermediary coupling, as a protective sheath or shield, for added or variable weight, and/or for aesthetic or design reasons. Optionally, a first cover 330 may be included to cover first end member 320 and/or a second cover 430 may be included to cover second end member 420. If included, first cover 330 and/or second cover 430 may be suited for any of a variety of reasons, including, but not limited to, as a protective sheath or shield, for added or variable weight, and/or for aesthetic or design reasons. In some embodiments, first cover 330 may include a first concave area or portion 326 and/or second cover 430 may include a second concave area or portion 426, for example, at or near respective first attachment area 325 and/or second attachment area 425. Concave areas 326, 426 may facilitate, for example, mating surfaces or surface area of first end member 320 and/or first cover 330 with second end member 420 and/or second cover 430.

Figure 4:
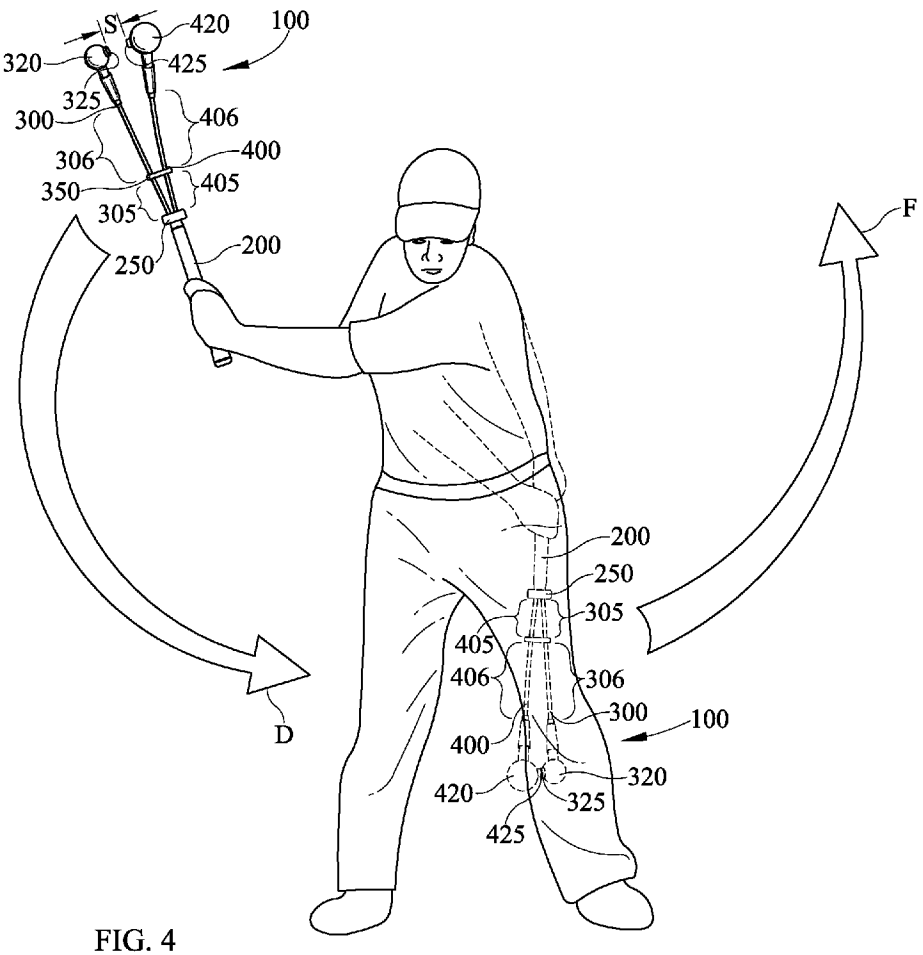
FIG. 4 is a side elevation view of an embodiment of a golf training aid as it may be used by a user.

First end member 320 and/or second end member 420 may include an attachment point or area and/or an attachment mechanism. For example, first end member 320 may include a first attachment area 325 and/or second end member 420 may include a second attachment area 425. Continuing this example, either or both of first attachment area 325 and second attachment area 425 may include a mechanism for attaching to the other such as, for example, magnets or magnetic components. In embodiments in which first attachment area 325 and/or second attachment area 425 include magnets, magnetic components, or other attachment mechanisms (e.g., hook-and-loop fasteners such as Velcro®, glues, adhesives, snaps or other mechanical fasteners, etc.), an attraction or attachment force may act on either or both of first attachment area 325 and second attachment area 425 to keep them attached, coupled, and/or connected. Such an attachment force may be varied (e.g., by varying the strength of one or more magnets, if magnets are used) as desired. Varying this attachment force may allow variability of the force required separate first attachment area 325 and second attachment area 425 and/or to allow variability of the propensity or tendency of the attachment force. For example, the attachment force may be based on a predetermined swing force or downswing force, such as is illustrated in FIG. 4 and discussed in more detail below.

A spacing adapter 350 may be included to, for example, reinforce first shaft 300 and/or second shaft 400, to vary the flexibility or stiffness of either or both first shaft 300 and second shaft 400, and/or to allow variability of the degree of difficulty of aligning first end member 320 and second end member 420 when swinging golf training aid 100. Spacing adapter 350 may span or bridge the distance between first shaft 300 and second shaft 400 at a location interposed between first handle end 301 and first terminal end 302 and/or interposed between second handle end 401 and second terminal end 402. Further, spacing adapter 350 may serve to limit or increase the distance that first end member 320 and second end member 420 may separate during a golf swing. Such limitation on separation distance may help reduce and/or vary the difficulty of causing the end member 320, 420 and/or of the attachment areas 325, 425 of aligning, attaching, and/or contacting one another.

Connection or attachment of spacing adapter 350 to first shaft 300 and second shaft 400 may form a first proximal portion 305 of first shaft 300 and/or a second proximal portion 405 of second shaft 400. Due at least in part to first proximal portion 305 and second proximal portion 405 being connected at either end (e.g., at first adapter 250 and spacing adapter 350), the relative bending, flexure, and/or movement of second proximal portion 405 relative to first proximal portion 305 can be reduced, minimized, and/or prevented. First shaft 300 may have a first distal portion 306 and/or second shaft 400 may have a second distal portion 406, either or both of which may be located between spacing adapter 350 (if included) and respective terminal end 302 or 402.

If second shaft 400 is more flexible than first shaft 300, and/or if first shaft 300 is more stiff than second shaft 400, then a swing force sufficient to overcome the attachment force (if included) between first attachment area 325 and second attachment area 425 may cause relative bending, flexing, and/or movement of second shaft 400 relative to first shaft 300 at least along second distal portion 406. Second distal portion 406 may bend or flex more than first distal portion 306 resulting in a separation of first attachment area 325 from second attachment area 425 and/or separation of first end member 320 from second end member 420, for example, as shown in FIG. 4 and described in more detail below.

First shaft 300 may be made more stiff than second shaft 400, and/or second shaft 400 may be made more flexible than first shaft 300, if so desired, in any of a variety of ways. For example, second shaft 400 may include a more flexible material, such as fiberglass, rubber, plastic, metal, wood, or any other material, or any combination thereof than first shaft 300 does. In some embodiments, for example, first shaft 300 may include or be constructed of metal (e.g., aluminum or steel), whereas second shaft 400 may include or be constructed of fiberglass. In some embodiments, second shaft 400 may be more flexible than first shaft 300 based at least partially on shape or form instead of or in addition to varying the materials used. For example, first shaft 300 may have a substantially thicker, more robust design, and/or may include geometry (e.g., cross-section) that provides more resistance to bending and/or flexing than that of second shaft 400.

Figure 7:
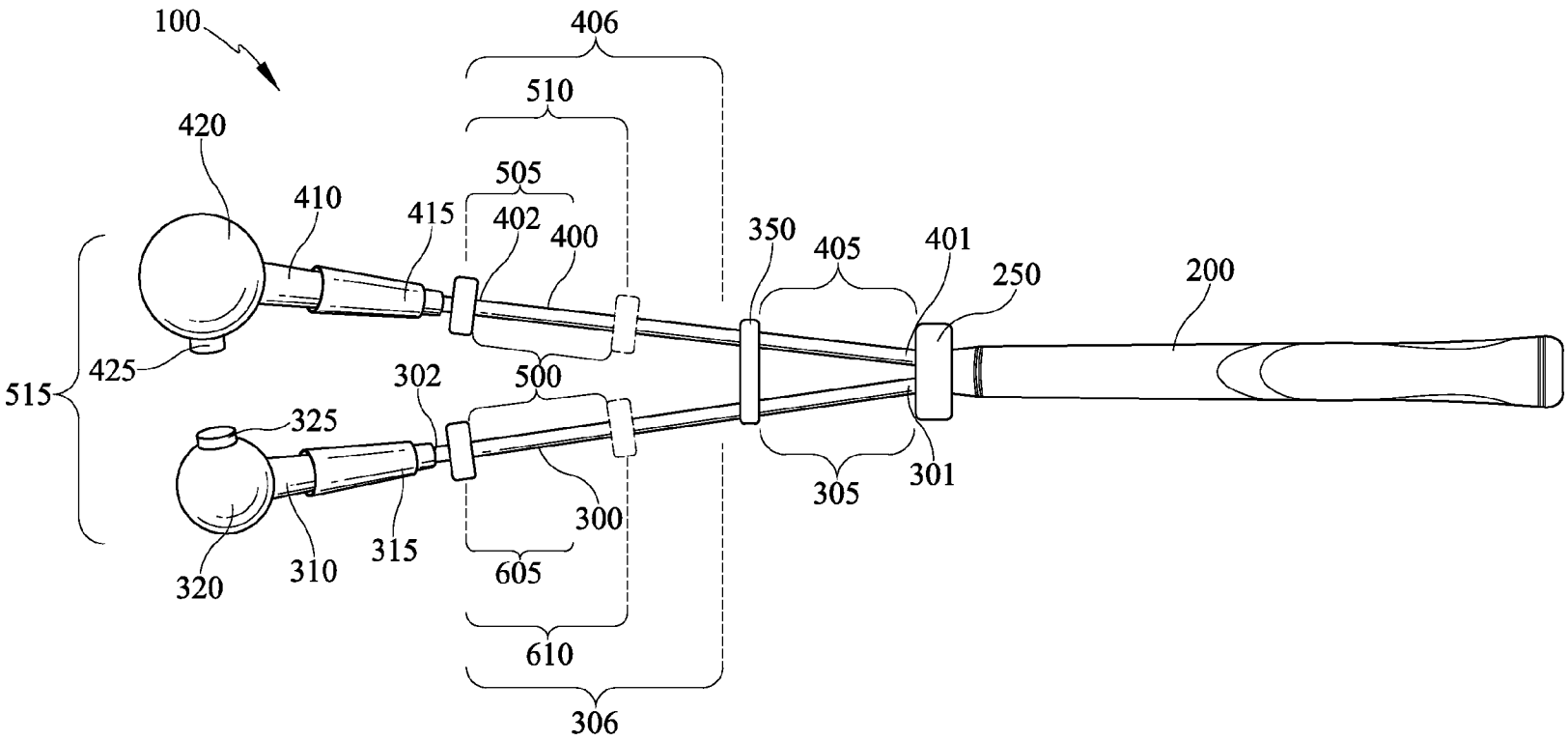
FIG. 7 is a perspective view of an alternative embodiment of a golf training aid.

In some embodiments, instead of or in addition to varying materials and/or shapes of first shaft 300 and second shaft 400, either or both of first shaft 300 and second shaft 400 may include coupling, joints, springs, or other components, or any combination thereof, to vary the relative flexibility and/or stiffness of first shaft 300 and/or second shaft 400. It is understood that these are merely examples of how first shaft 300 may be made more stiff than second shaft 400 and/or second shaft 400 may be made more flexible than first shaft 300, and that relative flexibility, stiffness, and/or ability to bend, flex, or deflect, may be varied in any of a variety of ways instead of or in addition to the aforementioned examples. It is further understood that first shaft 300 and second shaft 400 may be substantially equal in length, size, thickness, and/or stiffness, and are not required to have any substantial differences (i.e. they may have substantially identical characteristics). For example, as illustrated in FIG. 7, separation of first shaft 300 from second shaft 400 (and/or of first end member 320 from second end member 420 and/or of first attachment area 325 from second attachment area 425) may be achieved by addition of one or more weights 500 such as, for example, as described below.

Varying the position of spacing adapter 350 may vary the length of proximal portions 305, 405 and/or may vary the length of distal portions 306, 406. For example, moving or locating spacing adapter 350 to or at second spacer position 351 may result in a first intermediate distal portion 307 and/or a second intermediate distal portion 407 in which first intermediate distal portion 307 is shorter than first distal portion 306 and/or second intermediate distal portion 407 is shorter than second distal portion 406. Moreover, in some embodiments, spacing adapter 350 may be moved or located to or at a third spacer position 352, which may result in a first shortened distal portion 308 and/or a second shortened distal portion 408. First shortened distal portion 308 may be shorter than first intermediate distal portion 307 and/or second shortened distal portion 408 may be shorter than second intermediate distal portion 407. By moving spacing adapter 350 further from grip or handle 200, the relative movement between end members 320, 420 may be reduced. Therefore, the beginner may move spacing adapter 350 toward end members 320, 420. Alternatively, more skilled players may move spacing adapter 350 toward grip or handle 200 (and away from end member 320, 420).

Figure 5:
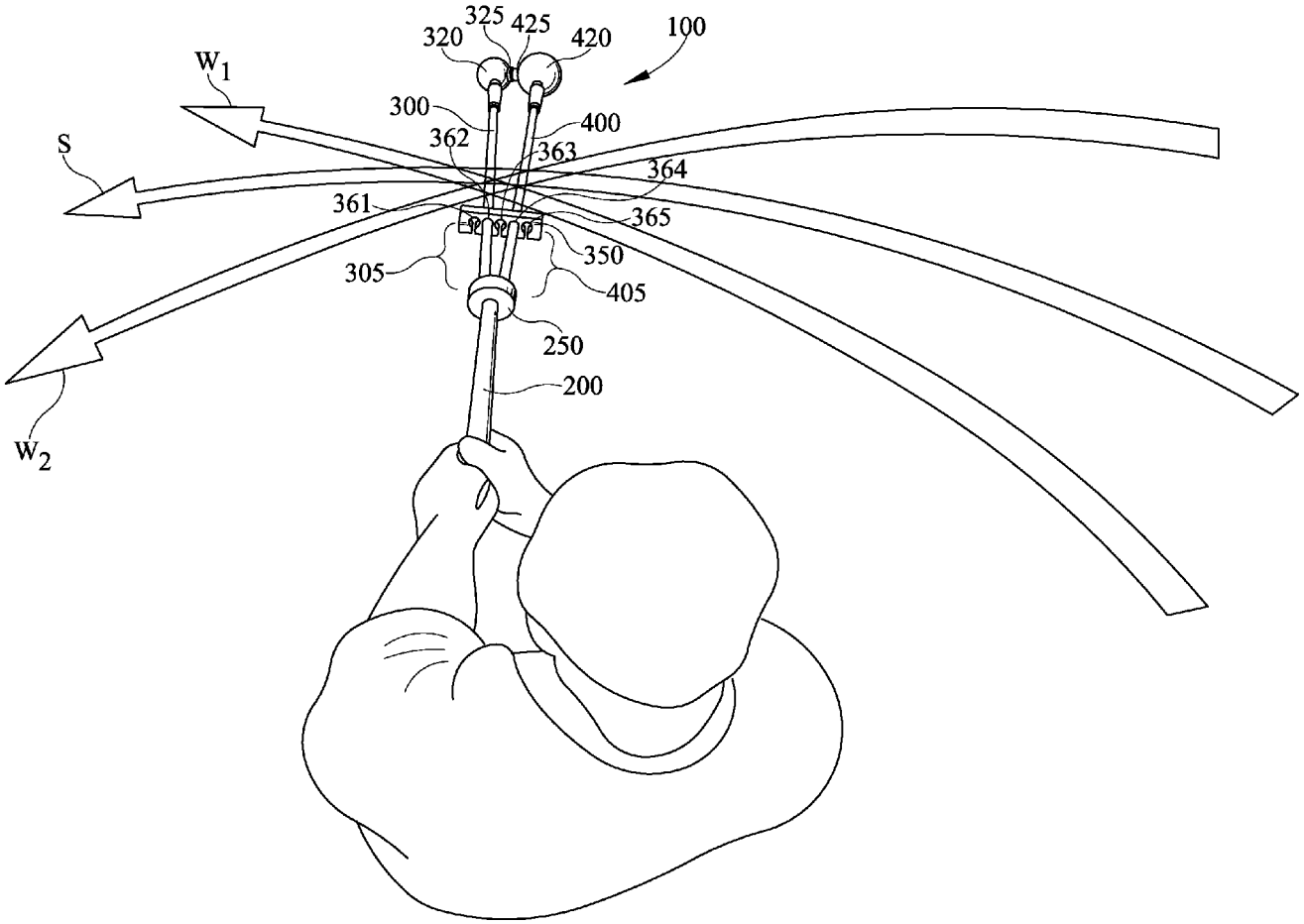
FIG. 5 is a top view of an exemplary user and an embodiment of a golf training aid depicting a variety of exemplary swing paths.

As shown in FIGS. 3 and 5, in some embodiments spacing adapter 350 may have a plurality of slots or apertures 361, 362, 363, 364, 365 that may be selectively used to position spacing adapter 350 on first shaft 300 and/or second shaft 400. For example, aperture 362 may engage first shaft 300 and/or aperture 364 may engage second shaft 400 to achieve exemplary shaft distal portions 306 and 406, with one aperture (e.g., aperture 363 as shown in FIG. 5) interposed between shafts 300 and 400. The wider spacing of the shafts 300 and 400 at nearer end members 320 and 420 may be accommodated to achieve the shorter intermediary free shaft portions 307 and 407 by, for example, locating spacing adapter 350 at or near second spacer position 351 and/or leaving two apertures open between shafts 300 and 400 (e.g., first shaft 300 may engage aperture 361 and second shaft 400 may engage aperture 364 leaving apertures 362 and 363 open and between shafts 300 and 400), or first shaft 300 may engage aperture 362 and second shaft 400 may engage aperture 365 leaving apertures 363 and 364 open and between shafts 300 and 400). Continuing this example, the even wider spacing of the shafts 300 and 400 at third spacer position 352 may be accommodated by leaving three apertures open between shafts 300 and 400 (e.g., first shaft 300 may engage aperture 361 and second shaft 400 may engage aperture 365 leaving apertures 362, 363, and 364 open and between shafts 300 and 400). It is understood that use of apertures 361, 362, 363, 364, and 365, and/or engaging the aforementioned apertures in order to achieve the spacing adapter positions and/or free shaft portion lengths are merely exemplary. Spacing adapter 350 is not required to be positionable at a variety of locations on either or both of first shaft 300 and second shaft 400, and apertures are not required to be used to achieve any variable positioning, as a variety of other methods or mechanisms may be used instead of or addition to apertures 361, 362, 363, 364, or 365.

By making the first distal portion 306, 307, or 308, and/or the second distal portion 406, 407, or 408 shorter, less bending, flexing, or movement of the more flexible or second shaft 400 relative to the more stiff or first shaft 300 may occur, and thus less movement of second end member 420 relative to first end member 320 may occur. In this way, the relative difficulty of aligning first attachment area 325 with second attachment area 425 may be adjusted based on the positioning of spacing adapter 350. For example, positioning or locating spacing adapter 350 closer to first handle end 301 and/or second handle end 401 may result in a relatively high degree of difficulty concerning causing alignment of first attachment area 325 with second attachment area 425 during a swing, at least in part due to the relatively high amount of bending, flexing, or movement that can occur with a relatively long first distal portion 306 and/or second distal portion 406. Conversely, continuing this example, positioning or locating spacing adapter 350 closer to third spacer position 352 may result in a relatively low degree of difficulty concerning causing alignment of first attachment area 325 with second attachment area 425 during a swing, at least in part due to the relatively low amount of bending, flexing, or movement that can occur with a relatively short first distal portion 306 and/or second distal portion 406. Spacing adapter 350 may include and/or be formed of a sufficiently resilient material capable of resisting stretching or deformation, for example due to tensile stress or force. Spacing adapter 350 may include any of a variety of materials, including, but not limited to, plastic, rubber, wood, metal, or any other material or any combination thereof.

Referring now to FIG. 4, an embodiment of golf training aid 100 is shown as it may be used, for example, by an individual swinging golf training aid 100 as a golf club and/or holding it by handle 200. In the downward or contact position shown in dashed lines, first attachment area 325 and second attachment area 425 may be substantially attached or connected, for example as described above. In this downward or contact position, first shaft 300 and second shaft 400 may be coplanar in the first plane and/or aligned, for example, with first shaft 300 forward of second shaft 400 relative a downswing D and/or a follow through F. The individual or user may pull golf training aid 100 back to a top position (as is normal during a backswing of a golf swing), such as is shown in solid lines, for example. In the top position, the user may accelerate the golf training aid 100 downward as indicated by downswing D. This acceleration force if sufficient to overcome any attachment force that may exist between first attachment area 325 and second attachment area 425, for example as described above, may cause second shaft 400 (which may trail first shaft 300 through downswing D) to bend or flex at least along second distal portion 406 relative to first shaft 300 and/or first distal portion 306. Such bending or flexing may result in second end member 420 separating from first end member 320 as indicated by a separation or separation distance S.

Separation distance S may vary for any of a variety of reasons, including, but not limited to, the flexibility of second shaft 400 and/or second distal portion 406, the length of second distal portion 406 (which may vary, for example, by varying the position of spacing adapter 350 as described above), and/or the weight(s) of first end member 320, second end member 420, first cover 330 (shown in FIG. 2), second cover 430 (shown in FIG. 2), first shaft 300, second shaft 400, and/or any other component described herein or any other component. In some embodiments, separation distance S, and/or whether any separation of first end member 320 and second end member 420 occurs, may be at least partially determined by an attachment force between first end member 320 (and/or first attachment area 325) and second end member 420 (and/or second attachment area 425), which attachment force may in turn be set or caused to correlate or respond based on a predetermined or desired swing force. Thus, separation S may be made to occur only when a predetermined or desired swing force is achieved by the user.

The acceleration and/or force used to cause downswing D and/or sufficient to cause separation S, may cease and/or cease to be sufficient to maintain separation S (i.e. second end member 420 may catch up to first end member 320 due to a decrease or termination of bending or flexing of second shaft 400 and/or second distal portion 406 relative to first shaft 300 and/or first distal portion 306). This may occur, for example, at the bottom or end of downswing D, at a normal contact position, and/or at the beginning or prior to follow-through F. If so, separation S may terminate and, if aligned, second end member 420 may approach and/or contact first end member 320, for example, via first attachment area 325 and/or second attachment area 425, which may result in attachment or re-attachment of first attachment area and/or first end member 320 to second attachment area 425 and/or second end member 420. In some embodiments, separation S at the top of the swing and re-attachment or contact at the bottom of the swing may indicate a proper or desired swing or swing path, for example, through a proper or desired swing plane.

It is understood that separation, contact, attachment, and/or re-attachment of first attachment area 325 and second attachment area 425 is merely an example of how a proper swing or swing path may be indicated. Any of a variety of indicators may be used, if any indication is used at all, as use or employment of any indicator or indication is optional. For example, first attachment area 325 and second attachment area 425 may contact one another when golf training aid 100 is swung properly to create an audible (e.g., a click, a ping, and/or a clang) and/or visual (e.g., light and/or spark) indication or indicator instead of, or in addition to, separation, contact, and or attachment as described above or otherwise. Moreover, first attachment area 325 and/or second attachment area 425 are not required as, for example, first end member 320 may contact and/or attach to second end member 420 (and/or second attachment area 425) directly or via an intermediary member instead of (or in addition to) first attachment area 325. Furthermore, in some embodiments, second end member 420 may contact and/or attach to first end member 320 (and/or first attachment area 325) directly or via an intermediary member instead of (or in addition to) second attachment area 425.

Referring now to FIG. 5, a plurality of exemplary swing paths are shown through which golf training aid 100 may potentially be swung by a user. For example, swing path S may exemplify a preferred and/or predetermined swing path and/or swing plane. Furthering this example, when golf training aid 100, first shaft 300, and/or second shaft 400 are swung through swing plane S, first shaft 300 and second shaft 400 may be coplanar and/or coplanar with swing path S and/or be aligned therein such that first end member 320, first attachment area 325, second end member 420, and/or second attachment area 425 are aligned and may contact and/or attach to the other(s). An exemplary errant or wrong swing path $W_1$ may represent an in-to-out swing path and/or another exemplary errant or wrong swing path $W_2$ may represent an out-to-in swing path. As discussed below, wrong swing paths W1 and W2 may result in a failure to achieve attachment of first end member 320 to second end member 420 via first attachment area 325 and second attachment area 425, respectively, and/or indication of a proper swing path or swing plane due to misalignment of first end member 320 and/or first attachment area 325 with second end member 420 and/or second attachment area 425.

Figure 6B:
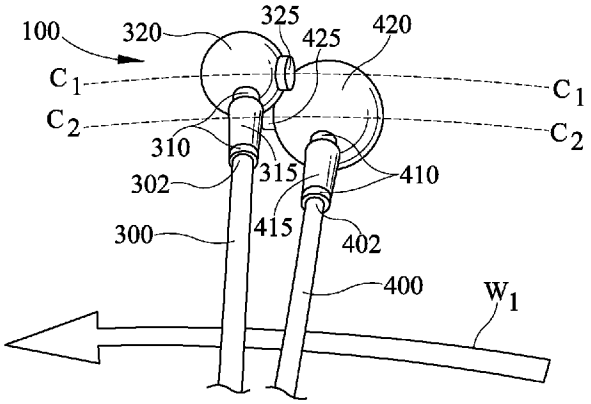
FIG. 6B is a perspective view of the portion of the golf training aid of FIG. 6A shown in an exemplary first unaligned configuration.
Figure 6C:
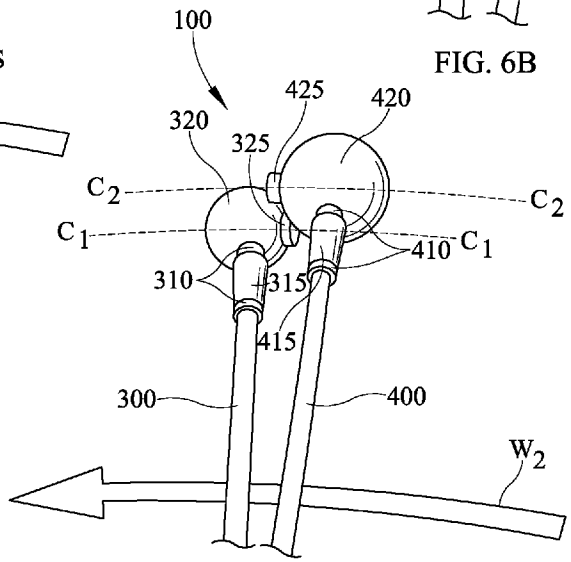
FIG. 6C is a perspective view of the portion of the golf training aid of FIG. 6A shown in an exemplary second unaligned configuration.
Figure 6A:
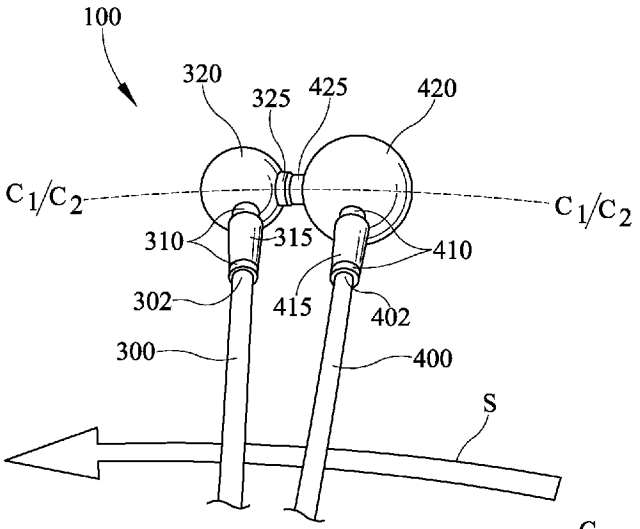
FIG. 6A is a perspective view of a portion of an embodiment of a golf training aid shown in an exemplary aligned configuration.

FIG. 6A shows an exemplary close-up view of first end member 320, first attachment area 325, second end member 420, and second attachment area 425 when golf training aid 100 is swung through the proper or predetermined swing plane or swing path S. First end member 320 and/or first attachment area 325 may have a centerline C1 extending therethrough, and/or second end member and/or second attachment area 425 may have a centerline C2 extending therethrough. In the exemplary golf training aid 100 and swing path S shown in FIG. 6A, centerlines C1 and C2 are aligned; and first end member 320, first attachment area 325, second end member 420, and second attachment area 425 are also aligned. Thus attachment of first attachment area 325 and second attachment area 425 may occur (and/or contact or indication of a proper swing through proper or predetermined swing plane or swing path S may be provided). FIGS. 6B and 6C show exemplary misalignment of centerlines C1 and C2 due to swinging golf training aid 100 through exemplary wrong swing paths W1 and W2, respectively. An in-to-out swing path as indicated by W1 may result in second end member 420 and/or second attachment area 425 moving below, closer to the user, and/or otherwise misaligned relative to first end member 320 and/or first attachment area 325 such that, for example, no attachment, contact, and/or indication of a proper swing occurs. An out-to-in swing path as indicated by W2 may result in second end member 420 and/or second attachment area 425 moving above, further away from the user, and/or otherwise misaligned relative to first end member 320 and/or first attachment area 325 such that, for example, no attachment, contact, and/or indication of a proper swing occurs. Thus, golf training aid 100 may be used, for example, as a training device indicating to a user (or to someone assisting the helper) when a proper swing path has been achieved.

Referring now to FIG. 7, an alternative embodiment of a golf training aid 100 is depicted having one or more weights 500 affixed thereto. Weights 500 may be added at any of a variety of locations on golf training aid 100 to, for example, add inertia and thereby alter or vary a separation 515 between first end member 320 and second end member 420 (and/or between first attachment area 325 and second attachment area 425). For example, a plurality of weights 500 may be provided, with the weight or mass varying between the different weights 500. A heavier or larger weight 500 may have greater influence on separation 515, thereby altering the difficulty of aligning and/or causing attachment of first attachment member 325 and second attachment member 425. Instead of or in addition to altering the weight or mass of weights 500, the location of the weights 500 on golf training aid 100 may be altered or varied. For example, moving or locating weight 500 a relatively large distance 510 on second shaft 400 from second terminal end 402 (i.e. relatively close to spacing adapter 350 and/or handle 200) may result in some added difficulty over having no weight 500 at all on second shaft 400, but a relatively low degree of added difficulty (due at least in part to a relatively small moment arm between second shaft first end 401 and weight 500). Adding weight 500 closer to second terminal end 402 (e.g., at a lesser distance 505 and/or at or near second terminal end 402) may increase the degree of difficulty in aligning attachment members 325, 425 and/or end member 320, 420, due to the increased moment arm between spacing adapter 350 and/or first adapter 250 and the location of weight 500.

Weight(s) 500 may also be added to first shaft 300 for any of a variety of reasons including, but not limited to, decreasing the level of difficulty in aligning end members 320, 420 and/or attachment areas 325, 425, and/or fine tuning the level of difficulty in conjunction with weight(s) 500 added to second shaft 400 (e.g., weight 500 added to first shaft 300 may somewhat negate the increased degree of difficulty resulting from adding weight 500 to second shaft 400, depending on the location of weight 500 on first shaft 300 and on second shaft 400). For example, weight(s) 500 may be added to first shaft 300 at a relatively large distance 610 and/or at a relatively small distance 605, and/or at or near first terminal end 302. Thus, a plurality of weights 500 may be added at a plurality of locations on second shaft 400, first shaft 300, and/or elsewhere on golf training aid 100.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of several methods and embodiments have been presented for purposes of illustration. It is not intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A golf training aid, comprising:

a handle;

a first shaft and a second shaft extending away from said handle, said first shaft and said second shaft substantially extending in a first plane;

a first end member connected to a first terminal end of said first shaft, said first terminal end disposed opposite a first handle end connected to said handle;

a second end member connected to a second terminal end of said second shaft, said second terminal end disposed opposite a second handle end connected to said handle;

said first end member having a first attachment area proximate said second end member and said second end member having a second attachment area proximate said first end member;

said first attachment area removably attachable to said second attachment area by an attachment mechanism when aligned in said first plane; and said first end member and said second end member separable by a swing force.

2. The golf training aid of claim 1 wherein said second shaft is more flexible than said first shaft.

3. The golf training aid of claim 1 wherein said first shaft and said second shaft have substantially the same stiffness.

4. The golf training aid of claim 3 further comprising at least one weight attached to at least one of said first shaft and said second shaft, said at least one weight allowing separation by said swing force.

5. The golf training aid of claim 1 further comprising:

a spacing adapter positionable on said first shaft between said first terminal end and said first handle end;

said spacing adapter positionable on said second shaft between said second terminal end and said second handle end; and said spacing adapter substantially preventing said second shaft from flexing relative to said first shaft along a proximal portion of said second shaft formed between said spacing adapter and said second handle end of said second shaft.

6. The golf training aid of claim 5 wherein said spacing adapter is positionable at a plurality of locations on said second shaft providing variability of a length of said proximal portion of said second shaft.

7. The golf training aid of claim 1 wherein said first end member and said second end member provide an indication when swung through said first plane.

8. The golf training aid of claim 7 wherein said indication is an attachment condition of said first end member to said second end member.

9. The golf training aid of claim 8 wherein said first end member and said second end member are removably attachable, and separable by said swing force.

10. The golf training aid of claim 1 wherein at least one of said first end member and said second end member is substantially in the form of a ball.

11. The golf training aid of claim 10 further comprising at least one outer cover covering at least a portion of said at least one of said first end member and said second end member.

12. A golf training aid, comprising:

a handle extending in a longitudinal direction;

a first shaft and a second shaft each extending outwardly away from said handle at least partially in said longitudinal direction, said first shaft and said second shaft in substantially spaced apart relationship and substantially coplanar in a first plane;

said first shaft having a first handle end connected to said handle and said second shaft having a second handle end connected to said handle;

said first shaft having a first terminal end opposite said first handle end and said second shaft having a second terminal end opposite said second handle end;

a first end member connected to said first terminal end of said first shaft;

a second end member connected to said second terminal end of said second shaft, said second end member in a separable contact with said first end member in a resting condition and separable from said first end member when subjected to a swing force;

said separable contact of said first end member and said second end member in said resting condition retaining said first shaft and said second shaft in spaced apart relationship; and said second shaft more flexible than said first shaft to allow separation of said first end member from said second end member when subjected to said swing force.

13. The golf training aid of claim 12 further comprising:

a spacing adapter positionable on said first shaft between said first handle end and said first terminal end;

said spacing adapter positionable on said second shaft between said second handle end and said second terminal end; and said spacing adapter substantially preventing said second shaft from flexing along a proximal portion of said second shaft formed between said spacing adapter and said second handle end of said second shaft.

14. The golf training aid of claim 13 wherein said spacing adapter is positionable at a plurality of locations on said second shaft providing variability of the length of said proximal portion of said second shaft.

15. The golf training aid of claim 12 wherein said first end member and said second end member provide an indication when swung through said first plane.

16. The golf training aid of claim 15 wherein said indication is an attachment condition of said first end member to said second end member.

17. The golf training aid of claim 15 wherein said indication is at least one of visual and audible.

18. The golf training aid of claim 17 further comprising at least one outer cover covering at least a portion of said at least one of said first end member and said second end member.

19. A golf training aid, comprising:

a handle;

a first shaft and a second shaft extending away from said handle, said first shaft and said second shaft substantially extending through a first plane;

a first end member connected to a first terminal end of said first shaft opposite said handle;

a second end member connected to a second terminal end of said second shaft opposite said handle;

said first end member removably attached to said second end member by an attachment mechanism when aligned in said first plane;

said second shaft more deflectable in said first plane than said first shaft due to a downswing having a downswing force;

said first end member and said second end member separated by said downswing force; and wherein a substantial change in direction of said downswing away from said first plane causes a first attachment area of said first end member to become substantially unaligned in said first plane with, and unattachable to, a second attachment area of said second end member.

20. The golf training aid of claim 19 further comprising:

a spacing adapter positionable on said first shaft;

said spacing adapter positionable on said second shaft; and said spacing adapter substantially preventing said second shaft from flexing along a proximal portion of said second shaft formed between said spacing adapter and said handle.

* * * * *